United States Patent [19]

St-Amour

[11] 4,016,912

[45] Apr. 12, 1977

[54] SCREWDRIVER FOR SLOTTED HEAD SCREW

[76] Inventor: Lionel St-Amour, 604 Francoise Loisel St., Boucherville, Quebec, Canada

[22] Filed: Dec. 15, 1975

[21] Appl. No.: 640,624

[52] U.S. Cl. ..... 145/50 A

[51] Int. Cl.[2] ..... B25B 15/00

[58] Field of Search ..... 145/50 A, 50 R

[56] References Cited

UNITED STATES PATENTS

| | | | |
|---|---|---|---|
| 697,836 | 4/1902 | Gorham | 145/50 A |
| 759,868 | 5/1904 | Eich | 254/104 |
| 1,476,653 | 12/1923 | Stanton | 145/50 A |
| 1,899,489 | 2/1933 | Wickbergh | 145/50 A |

FOREIGN PATENTS OR APPLICATIONS

| | | | |
|---|---|---|---|
| 18,702 | 8/1913 | United Kingdom | 145/50 A |

*Primary Examiner*—Al Lawrence Smith
*Assistant Examiner*—J. T. Zatarga

[57] ABSTRACT

A screwdriver of the type adapted to drive a slotted head screw and which is particularly adapted to firmly engage in a dull or deformed slot of such screw to drive the latter. This screwdriver includes a shank formed at one end with a head having a strikable end face and at the other end with a screw driving bit including a blade having a transverse outer edge, opposite side edges extending along the blade lengthwise of the shank, and protuberances on opposite sides of the blade at the opposite side edges thereof and extending lengthwise of the shank outwardly coextensive with the transverse edge to engage with the latter in a dull or deformed slot of a slotted head screw.

6 Claims, 7 Drawing Figures

SCREWDRIVER FOR SLOTTED HEAD SCREW

This invention relates to a screwdriver of the type used for slotted head screws.

The conventional screwdriver of the above type merely includes a transversely extending straight outer edge fitting in the slot of the screw to drive the latter for either screwing or unscrewing. With such screwdriver and slot, there often happens that the edges of the slot become dull or deformed and this prevents either complete screwing or unscrewing of the corresponding screw.

It is a general object of the present invention to provide a screwdriver of the above type which is particularly adapted to drive screws having a dull or deformed slot.

It is a more specific object of the present invention to provide a screwdriver of the above type which is adapted to tightly fit in a dull or deformed slot of a slotted head screw for screwing and/or unscrewing of the latter.

It is another object of the present invention to provide a screwdriver of the above type which includes a blade and projections adapted to firmly engage in a dull or deformed slot and with these projections or protuberances to hold the screwdriver against undesirable shifting lengthwise of the slot.

The above and other objects and advantages of the present invention will be better understood with the following detailed description of preferred embodiments thereof which are illustrated, by way of examples, in the accompanying drawings, in which.

Figure 1:
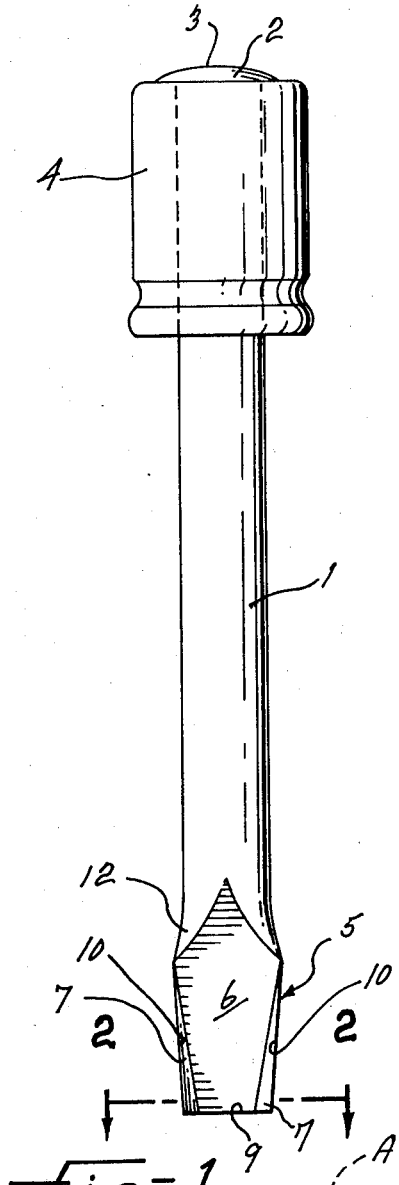
FIG. 1 is a side view of a screwdriver having a screw driving bit according to a first embodiment of the present invention.

The screwdriver illustrated in FIG. 1 includes a shank 1 in the general form of a rod having at one end an enlarged head 2 having an end face 3. The latter is blunt and convex for striking with a hammer or otherwise thereon, as better explained later.

A handle, in the form of a centrally apertured body 4, is engaged tight around the shank 1 and in abutment with the enlarged head 2. The handle 4 is made of any conventional material for such handle and, preferably, it is made of a non-conducting material.

Figure 2:
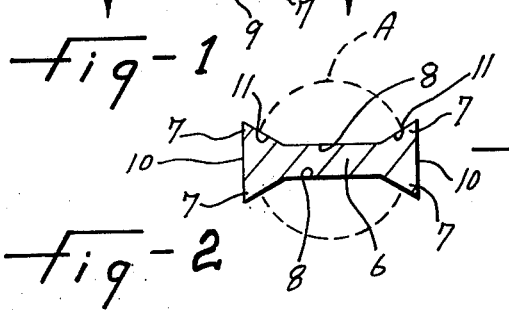
FIG. 2 is a cross-sectional view as seen along line 2—2 in FIG. 1 in relation to a screw head shown in dotted lines.

In the embodiment of FIGS. 1 and 2, the other end of the shank 1, relative to the end with the handle 4, is formed with a screw driving bit 5. This screw driving bit includes a blade 6 and elongated protuberances 7. The blade 6 defines opposite faces 8 and has a straight outer edge 9 extending lengthwise transversely of the shank 1. The blade 6 also includes a pair of opposite lateral edges 10 extending lengthwise of the shank. The protuberances 7, in the form of ridges, laterally project from the blade 6 at the opposite lateral edges 10 and extend lengthwise coextensive with the straight outer edge 9. The protuberances 7 laterally widen progressively toward the blade 6 at opposite lateral edges 10, as best shown in FIG. 2 such that the screwdriving bit at the outer edge 9 progressively widens toward the opposite ends of the latter at both ends of a central portion of this outer edge .This Figure illustrates four (4) such protuberances 7 formed with two on each of the opposite faces of the blade 6 and at each of the two opposite lateral edges 10. These protuberances 7 widen progressively to form flat faces 11 and they taper toward their inner end to gradually merge with the wider root portion 12 of the screw driving bit 6.

Figure 3:
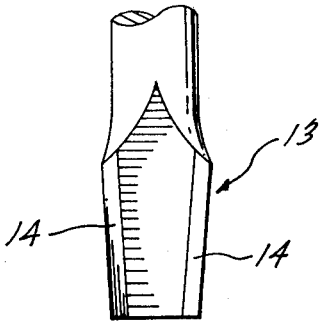
FIG. 3 is a side view of a driving bit according to a second embodiment of the present invention.

According to a second embodiment of the invention, shown in FIG. 3, the screwdriver may have a driving bit 13 which is similar to the driving bit 6, except for the protuberances 14 which are of uniform triangular cross-section throughout their length.

Figure 4:
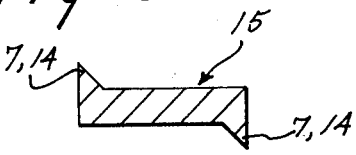
FIGS. 4 to 7 inclusive illustrate as many other cross-sections of driving bits comparable to the cross-section of FIG. 2.
Figure 5:
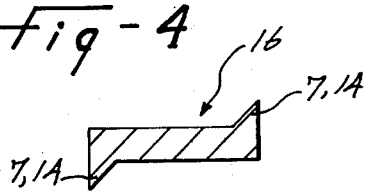

FIGS. 4 and 5 illustrate other driving bits 15 and 16 respectively and seen in cross-section as in FIG. 2. These screwdriving bits may be of the type of either FIG. 1 or FIG. 3, except that they each include only two elongated protuberances 7 or 14 formed on the opposite sides of the blade 6 and adjacent opposite lateral edges respectively of the latter. It must be noted that the protuberances 7 or 14 of the screwdriving bit 15 angularly lead the blade 6 in the conventional screwing direction of rotation of the screwdriver, while for the bit 16, the protuberances angularly lead in the other direction corresponding to the conventional unscrewing direction of rotation.

Figure 6:
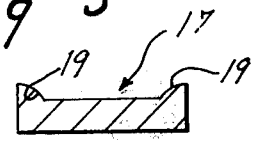
Figure 7:
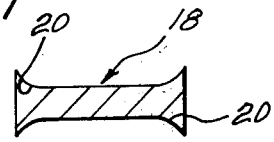

FIG. 6 illustrates another screwdriving bit 17 in which the protuberances project from only one of faces 8 and further have a convex face 19. FIG. 7 illustrates a screwdriving bit 18 which differs from the screwdriving bits 5 and 13 solely by their concave faces 20. Obviously, faces 20 could be convex as in FIG. 6.

The screwdriver according to the present invention is used by inserting the free outer edge 9 in a dull or deformed slot of a slotted screw head A. If necessary, firm engagement of the protuberances in such slot is thus obtained and may, in certain cases, require hammering or striking on end face 3 of the head 2 of the screwdriver.

It is essential that the overall length of the outer edge 9 of blade 6 be greater than the diameter or predetermined length of the slot in a screw head A, as shown in FIG. 2.

It must be understood that the screwdriver according to the present invention is made to be used with a screw having a slot of predetermined length and width. For this purpose, the present screwdriver comprises a screwdriving bit having opposite faces converging toward each other lengthwise of said shank and toward a cooperatively formed straight outer edge extending lengthwise transversely of said shank, having an overall length exceeding the predetermined length of said slot, and having a central portion of even thickness not exceeding said predetermined width and of a length less than said predetermined length. Said protuberances on the opposite faces of the screwdriver bit, at the opposite lateral edges, end lengthwise of the shank coextensive with the straight outer edge.

Thus, as compared to a conventional screwdriver, the screwdriver of the present invention engages the radially outer edge portions of the dull or damaged slot of a screw head and, thus, provides substantial grip of the slotted head.

what I claim is:

1. A screwdriver for a screw having a slot of predetermined length and predetermined width on the head thereof, said screwdriver comprising a shank, a handle and a screwdriving bit fixed at the opposite ends of said shank, said screwdriving bit having opposite faces converging toward each other lengthwise of said shank and toward a cooperatively formed straight outer edge extending lengthwise transversely of said shank, having an overall length exceeding the predetermined length of said slot, and having a central portion of even thickness not exceeding said predetermined width and of a length less than said predetermined length, said opposite faces having opposite lateral edges extending lengthwise longitudinally of said shank, protuberances on said opposite faces at said opposite lateral edges ending lengthwise of said shank outwardly coextensive with said straight outer edge, and said bit at said straight outer edge progressively increasing in thickness at both ends of the outer edge, from said central portion of even thickness to the corresponding ends respectively of the straight outer edge, thereby producing tight engagement of part of said ends of increased thickness in the opposite ends of said slot.

2. A screwdriver as defined in claim 1, wherein said protuberances are formed one on each of the two opposite faces of the blade and adjacent said opposite lateral edges respectively of the blade.

3. A screwdriver as defined in claim 1, wherein said protuberances are formed on the two opposite faces of the blade at each of said opposite lateral edges respectively.

4. A screwdriver as defined in claim 1, wherein said one end of the shank is enlarged relative to the latter and has a blunt end face for striking thereon.

5. A screwdriver as defined in claim 4, wherein said handle constitutes a centrally apertured body inserted around said shank in outward abutment against said enlarged one end.

6. A screwdriver as defined in claim 5, wherein said protuberances are formed on the two opposite faces of the blade at each of said opposite lateral edges respectively.

* * * * *